US007419407B1

(12) United States Patent
Jolly et al.

(10) Patent No.: US 7,419,407 B1
(45) Date of Patent: Sep. 2, 2008

(54) ELECTRICAL CONNECTOR WITH STACKED CONTACTS

(75) Inventors: Timothy D. Jolly, Longmont, CO (US); Paul R. King, Longmont, CO (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 11/626,422

(22) Filed: Jan. 24, 2007

Related U.S. Application Data

(60) Provisional application No. 60/744,967, filed on Apr. 17, 2006.

(51) Int. Cl.
*H01R 9/22* (2006.01)

(52) U.S. Cl. ..... 439/714

(58) Field of Classification Search ..... 439/714
See application file for complete search history.

(56) References Cited

U.S. PATENT DOCUMENTS 3,399,272 A * 8/1968 Uberbacher ..... 439/60
3,998,513 A * 12/1976 Kobayashi et al. ..... 439/91
4,199,209 A * 4/1980 Cherian et al. ..... 439/591
4,408,814 A * 10/1983 Takashi et al. ..... 439/91
4,577,922 A * 3/1986 Stipanuk et al. ..... 439/629
4,665,614 A * 5/1987 Stipanuk et al. ..... 29/884
4,871,316 A * 10/1989 Herrell et al. ..... 439/66
4,921,430 A * 5/1990 Matsuoka ..... 439/72
4,998,886 A * 3/1991 Werner ..... 439/66
5,052,953 A * 10/1991 Weber ..... 439/857
5,169,321 A * 12/1992 Matsuoka ..... 439/71
5,295,840 A * 3/1994 Matsuoka ..... 439/72
5,913,699 A * 6/1999 Zielke ..... 439/632
7,097,491 B2 * 8/2006 Neumann-Henneberg ... 439/395
7,168,990 B2 * 1/2007 Suzuki et al. ..... 439/636
2005/0176269 A1 * 8/2005 Grant et al. ..... 439/66

* cited by examiner

*Primary Examiner*—Ross N Gushi
(74) *Attorney, Agent, or Firm*—Shumaker & Sieffert, P.A.

(57) ABSTRACT

An electrical connector that is particularly suited for electrical test equipment is disclosed. A plurality of electrical contacts are disposed within a stack. At least one insulator is disposed between each adjacent pair of electrical contacts in the stack as well. Each electrical contact includes a mating connector interface surface that is electrically engageable with an electrical contact of a mating electrical connector, for instance associated with a device under test.

20 Claims, 7 Drawing Sheets

ELECTRICAL CONNECTOR WITH STACKED CONTACTS

CROSS-REFERENCE TO RELATED APPLICATIONS

This patent application claims priority under 35 U.S.C. §119(e) to U.S. Provisional Patent Application Ser. No. 60/744,967, that was filed on Apr. 17, 2006, that is entitled "ELECTRICAL TEST CONNECTOR WITH VARIABLE POSITIONS," and the entire disclosure of which is incorporated by reference in its entirety herein.

BACKGROUND OF THE INVENTION

Testing devices or electrical test equipment (ETE) of various types exist. Devices that are tested by the ETE are oftentimes referred to as a "device under test" or a DUT, at least during the time of testing. One example of an electronic device that is subjected to a number of tests or the like prior to being released to the consumer are disc drive devices. There may be a need to provide one or more electrical signals to one or more of the various components within the drive both for testing purposes and servo writing operations. Other examples of electronic devices that are typically tested prior to being released include without limitation devices that incorporate a printed circuit board.

Typical ETE use what are commonly referred to as one or more "pogo pins" or probes to establish an electrical connection with a DUT. A pogo pin-type electrical connector in the case of a disk drive ETE is a four-piece assembly—a probe body, a receptacle in the probe body, a pogo pin or probe disposed within the receptacle, and a return spring that is disposed within the receptacle and that biases its corresponding pogo pin in the direction of maintaining electrical contact with the mating connector. This four-piece assembly is normally press-fit into a precision-machined housing, which in turn is mounted to a printed circuit board.

Pogo pin-type electrical connectors are susceptible to damage when the DUT and the ETE are misaligned. For instance, a misaligned pogo pin of the ETE may get wedged or squeezed in between two adjacent contacts of the DUT. In any case, at least a certain misalignment between the ETE and the DUT may expose one or more pogo pins to a "side force"—a force that is not directed along the length dimension of the pogo pin and that coincides with the direction that the pogo pin is intended to move when engaged with a mating connector (e.g., the vector of the force and the central axis of the pogo pin are not coaxial in this case). Forces of this type may bend one or more pogo pins or otherwise adversely affect their operability in some respect.

In ETE used with disc drives, the electrical connector is exposed to what may be characterized as a high cycle environment—one in which a DUT is engaged with the electrical connector for testing, and is thereafter disengaged on a frequent basis. For example, a high cycle ETE may accept a disk drive every three minutes for executing one or tests or performing one or more operations on the disk drive. It is not uncommon for this type of ETE to run 24 hours a day, seven days a week. Therefore, the pogo pin-type electrical connector is highly susceptible to becoming damaged, having one or more of its parts simply wear out, or both. A damaged pogo pin-type electrical connector should of course be replaced, and therefore subjects the ETE to down-time and a corresponding reduction in productivity.

SUMMARY OF THE INVENTION

A first aspect of the present invention is directed to an electrical connector. This electrical connector includes a plurality of first electrical contacts and at least one first insulator that are stacked together in a first dimension. That is, the stack extends in the first dimension. At least one first insulator is disposed between each adjacent pair of first electrical contacts within the stack, and may be referred to as an "intermediate first insulator."

DETAILED DESCRIPTION

Figure 1A:
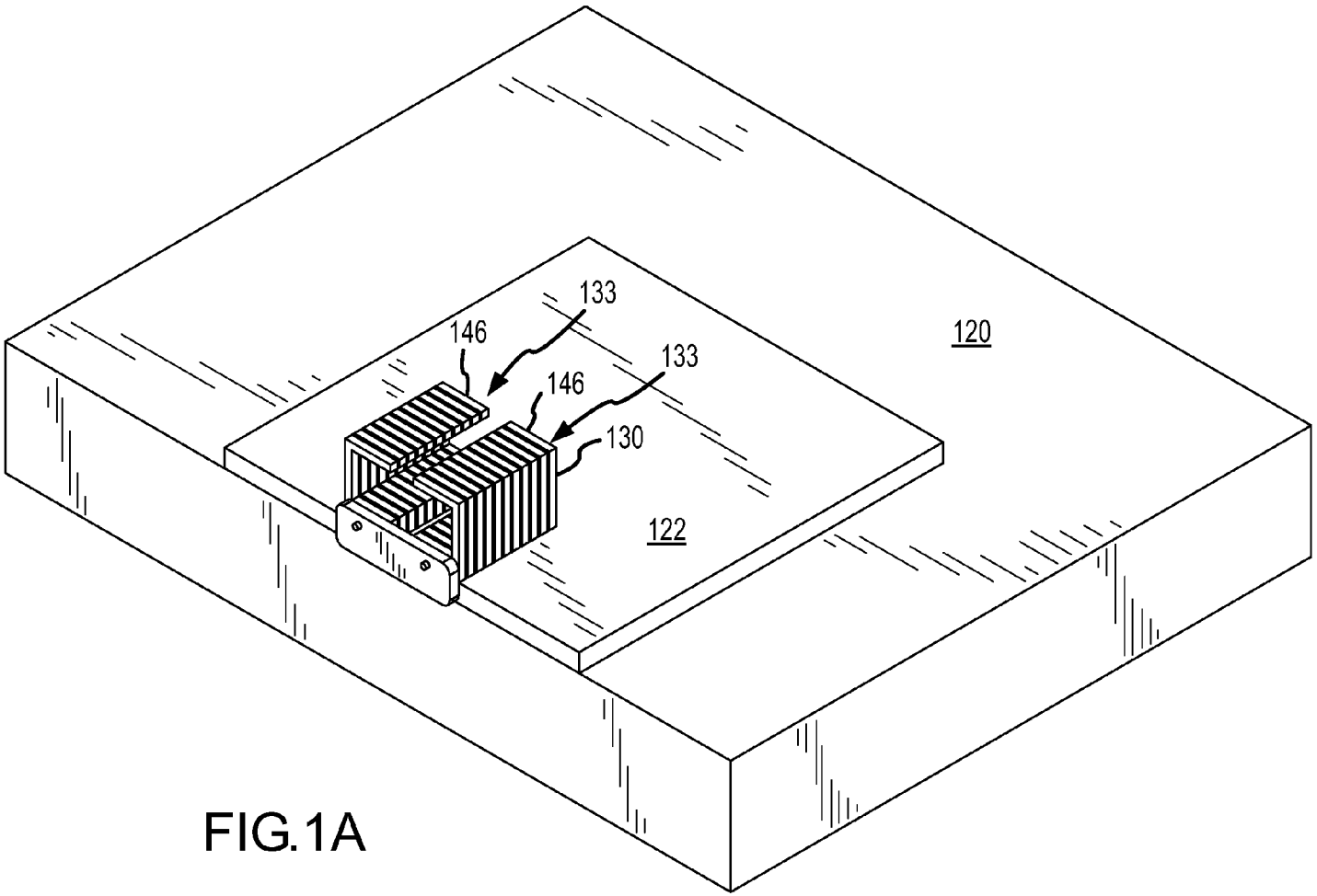
FIG. 1A is schematic representation of an electrical apparatus having one embodiment of an electrical connector with stacked electrical contacts.

FIG. 1A is a schematic representation of an electrical apparatus 120 of any appropriate size, shape, configuration, and/or type, and further which provides any appropriate function or combination of functions. An example of the configuration for the electrical apparatus is a testing device or electrical test equipment (ETE), and therefore the electrical apparatus 120 hereafter will be referred to as an ETE 120. The ETE 120 may be of any appropriate size, shape, configuration, and/or type, may be used to execute any appropriate test or combination of tests, and may be used to test any appropriate type of device or types of devices (e.g., disk drives). What is of importance in relation to the ETE 120 is its use of an electrical connector 130, which may be incorporated by the ETE 120 in any appropriate manner and at any appropriate location, and which will be discussed in more detail below. In the illustrated embodiment, the electrical connector 130 is mounted on a printed circuit board 122. The electrical connector 130 is particularly suited for use with any electrical apparatus that is engaged and disengaged with another electrical device on a frequent basis (e.g., an electrical apparatus used in a production or production-like setting).

Figure 1B:
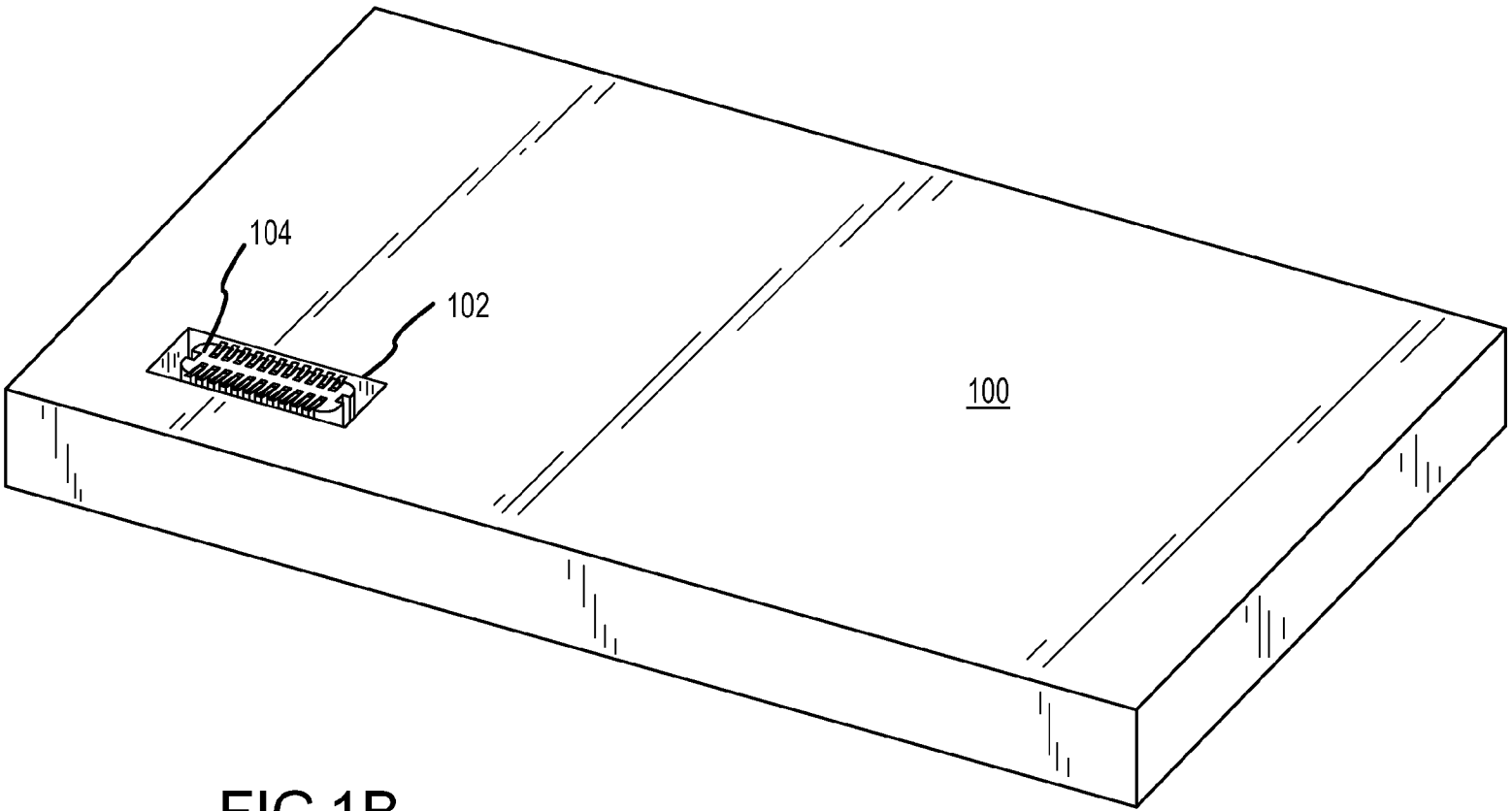
FIG. 1B is a schematic representation of a device under test and a connector for interfacing with the electrical connector of the electrical apparatus of FIG. 1A.

FIG. 1B is a schematic representation of a device 100 that may be tested using the ETE 120 of FIG. 1A, and which may be referred to as "device under test" or DUT 100 at least when being tested by the ETE 120. The device 100 may be of any appropriate size, shape, configuration, and/or type, and may provide any appropriate function or combination of functions. In one embodiment, the device 100 is in the form of a disk drive. Other examples for the device 100 include devices that utilize a printed circuit board. In fact, the device 100 could simply be in the form of a printed circuit board.

The device 100 includes an electrical connector 104 that electrically interconnects with the electrical connector 130 of the ETE 120 when the device 100 is being tested. The electrical connector 104 may be of any appropriate size, shape, configuration, and/or type, and further may be disposed at any appropriate location in relation to the device 100. In the illustrated embodiment, the electrical connector 104 is at least somewhat internally disposed, and is accessible through an aperture 102 (e.g., an aperture in a base plate of a disk drive). Additional features of the electrical connector 104 will be discussed in more detail below in relation to the operational summation provided in relation to FIGS. 4A-B.

FIGS. 2 and 3A-C present various views of the electrical connector 130 of the ETE 120. The electrical connector 130 includes at least one stack 133 of a plurality of electrical contacts 140, with at least one insulator 150 being disposed between each adjacent pair of electrical contacts within the stack 133. Each insulator 150 is part of and defines a portion of its corresponding stack 133. That is, a plurality of electrical contacts 140 and at least one insulator 150 are stacked in a dimension noted by the dimension "S" in FIG. 3C. Adjacent components of each stack 133 are disposed in abutting or interfacing relation.

Using one or more stacks 133 to define the electrical connector 130 allows the electrical connector 130 to be readily adapted for a particular application. Electrical contacts 140 (along with each insulator 150 disposed between each adjacent pair of electrical contacts 140) may be added to or subtracted from the stack 133 as desired/required, for instance depending upon the requirements of the mating connector (e.g., electrical connector 104). That is, one application may require that an electrical connector 130 include a first number of electrical contacts 140, while another application may require that an electrical connector 130 include a different number of electrical contacts 140. The electrical connector 130 need not be re-designed for use with these different applications—only a different number of electrical contacts 140 and insulators 150 need to be included in the relevant stack(s) 133.

The various electrical contacts 140 and insulators 150 in a given stack 133 of the electrical connector 130 are disposed in alternating relation. Any appropriate number of electrical contacts 140 may be utilized in each stack 133 of the electrical connector 130 depending upon, for instance, the configuration of the mating connector (e.g., electrical connector 104 of FIG. 1B). Any appropriate number of stacks 133 of electrical contacts 140/insulators 150 may be utilized by the electrical connector 130 as well, including a single stack 133 (not shown). Multiple stacks 133 of electrical contacts 140/insulators 150 used by the electrical connector 130 may be disposed in any appropriate arrangement. In the illustrated embodiment, the electrical connector 130 uses a pair of stacks 133 of electrical contacts 140/insulators 150 that are disposed in at least substantially parallel relation, and the electrical contacts 140/insulators 150 of one stack 133 are the mirror image of the electrical contacts 140/insulators 150 of the opposite stack 133, although this may not be required in all instances (e.g., the tips of the cantilevers 146 associated with the electrical contacts 140 of one stack 133 and discussed below, may be disposed in opposing and spaced relation to tips of the cantilevers 146 associated with the electrical contacts 140 of the other stack 133).

Each stack 133 of electrical contacts 140/insulators 150 may be defined in any appropriate manner. Stated another way, any appropriate way of maintaining the various individual electrical contacts 140 and insulators 150 in a common stack 133 may be utilized. In the illustrated embodiment, a plurality of individual electrical contacts 140 are mounted on each of a pair of shafts 134 that are spaced from each other and each of which defines a stack 133, with one or more individual insulators 150 being disposed between each adjacent pair of electrical contacts 140 and mounted on the corresponding shaft 134 as well. That is, the various electrical contacts 140 and insulators 150 are disposed in alternating relation on each of the two shafts 134 used by the electrical connector 130 in the illustrated embodiment. Any appropriate number of shafts 134 could be utilized by the electrical connector 130, including a single shaft 134 (not shown). Multiple shafts 134 used by the electrical connector 130 may be disposed in any appropriate arrangement. In the illustrated embodiment, the shafts 134 are disposed in at least substantially parallel relation, and the electrical contacts 140/insulators 150 on one shaft 134 are the mirror image of the electrical contacts 140/insulators 150 on the opposite shaft 134, although this may not be required in all instances (e.g., the tips of the cantilevers 146 associated with the electrical contacts 140 of one shaft 134 may be disposed in opposing and spaced relation to tips of the cantilevers 146 associated with the electrical contacts 140 of the other shaft 134).

Another option for defining each stack 133 used by the electrical connector 130 would be to mount adjacently disposed components of the stack 133 to each other in any appropriate manner (e.g., using an appropriate adhesive or the like). For instance, each insulator 150 may be mounted to each adjacent electrical contact 140. The entirety of each interfacing surface between any given insulator 150 and any given electrical contact 140 could be bonded together in any appropriate manner, or only a portion of each such interfacing surface.

Each electrical contact 140 used by the electrical connector 130 may be formed from any appropriate material or combination of materials that provides a desired degree of conductivity. Notably, each electrical contact 140 is of an integral or one-piece construction—there is no joint of any kind between any adjacent portions of a given electrical contact 140. That is, the separate "probe" and "spring" components of a typical pogo pin connector are integrally incorporated into each individual electrical contact 140 (e.g., a single component (the electrical contact 140) provides both a probe function and a spring function). Having at least a certain degree of flexibility, deflectability, or "give" (e.g., preferably via an elastic or near-elastic deformation) in the structure of the electrical contacts 140 may enhance establishing an electrical connection with a mating connector (e.g., electrical connector 104). In one embodiment, each electrical contact 140 is elastically deflectable in the direction of the force applied thereto by the electrical contact of a mating connector (e.g., electrical contact 112 of electrical connector 104, discussed below).

The various electrical contacts 140 in a given stack 133 are preferably of a common size, shape, and configuration. Within a given stack 133, the electrical contacts 140 may be of any appropriate configuration, and this configuration may differ from that illustrated in FIGS. 2 and 3A-C depending upon, for instance, the configuration of the mating connector (e.g., electrical connector 104). That is, it should be appreciated that different types of ETE 120 may require that the electrical contacts 140 be of a different configuration from that described herein.

Each electrical contact 140 in each stack 133 used by the electrical connector 130 will typically include a deflectable section for interfacing with an electrical contact of a mating connector (e.g., an electrical contact 112 of electrical connector 104). In the illustrated embodiment, this deflectable section is in the form of a cantilever or a cantilever-like structure (e.g., what is commonly referred to as a "simply supported beam") and is further identified by a reference numeral 146. The cantilever 146 of each electrical contact 140 includes a mating connector interface surface 148—the surface of the electrical contact 140 that interfaces with the electrical contact of the mating connector (e.g., electrical contact 112 of electrical connector 104). The mating connector interface surface 148 of each electrical contact 140 is flat in the illustrated embodiment (e.g., FIG. 3C), although other configurations may be appropriate. The mating connector interface surfaces 148 associated with the electrical contacts 140 within a given stack 133 are co-planar in the illustrated embodiment, although such may not be required in all instances. Moreover, the mating connector interface surfaces 148 for the electrical contacts 140 within one stack 133 are also coplanar with the mating connector interface surfaces 148 for the electrical contacts 140 of the other stack 133 in the illustrated embodiment, although such also may not be required in all instances. In one embodiment, the various mating connector interface surfaces 148 for the electrical contacts 140 are disposed within a plane that is orthogonal/perpendicular to the relative motion required to establish an electrical connection between the electrical connector 130 and a mating connector (e.g., electrical connector 104), although orientations may be appropriate.

The mating connector interface surface 148 of the various electrical contacts 140 presents a surface (again, preferably flat) for interfacing with an electrical contact of a mating connector. It may be desirable to include one or more coatings, films, layers, or the like on each mating connector interface surface 148. In one embodiment, at least the mating connector interface surface 148 of each electrical contact 140 includes what may be characterized as a heavy Rhodium plating. This not only enhances the conductivity of each electrical contact 140, but also provides corrosion resistance and abrasion resistance properties. Other coatings, films, or layers that may be utilized include without limitation gold and beryllium-copper.

Although the mating connector interface surface 148 for each of the electrical contacts 140 may be of any appropriate shape in plan view, in the illustrated embodiment each such mating connector interface surface 148 defines a rectangular area. A length dimension for each of the above-noted mating connector interface surfaces 148 (designation "L" in FIG. 3C) may extend orthogonally to the dimension "S" in which the corresponding stack 133 extends (e.g., the "S" dimension corresponding with the length dimension of the corresponding shaft 134 in the illustrated embodiment). A width dimension for the mating connector interface surfaces 148 (designation "W" in FIG. 3C) may coincide with the dimension in which the corresponding stack 133 extends (e.g., the length dimension of the shaft 134 in the illustrated embodiment). In the illustrated embodiment, the length of each mating connector interface surface 148 is greater than its width. Having the length dimension of each mating connector interface surface 148 being greater than its corresponding width dimension provides a more relaxed "side-to-side" alignment tolerance for engaging and establishing electrical communication with the mating connector (e.g., electrical connector 104).

Further characterizations may be made in relation to the cantilevers 146 used by the electrical connector. One is that the cantilevers 146 in a given stack 133 may be disposed parallel to each other or in at least substantially parallel relation. The cantilevers 146 in one stack 133 may be disposed parallel to the cantilevers 146 of at least one other stack 133 used by the electrical connector 130, although such but not be required in all instances. The length dimension of each cantilever 146 (designation "L" in FIG. 3C) may be disposed orthogonally to the dimension "S" in which its corresponding stack 133 extends.

In the illustrated embodiment, each electrical contact 140 includes a third section 142, a second section 144, and the above-noted cantilever or first section 146. The second section 144 of each electrical contact 140 is disposed between its corresponding third section 142 and first section 146. Furthermore, each second section 144 is disposed in a different orientation than each of its corresponding third section 142 and the first section 146. The shaft 134 extends through an aperture on the third section 142 of each electrical contact 140 in the illustrated embodiment. The third section 142 of each electrical contact 140 is also disposed on and appropriately mounted to the printed circuit board 122 in the illustrated embodiment (e.g., by soldering). Therefore, the third section 142 of each electrical contact 140 may be characterized as an at least substantially stationary portion of the electrical contact 140. In the illustrated embodiment: 1) the second section 144 disposes its corresponding first section 146 in spaced relation to its corresponding third section 142; and 2) the first section 146 and its corresponding third section 142 are disposed in parallel relation, although other relative orientations may be appropriate.

The various electrical contacts 140 may be fabricated in any appropriate manner, such as by a chemical etch (e.g., chemically etching a thin, flat stock of beryllium copper or any other appropriate metal). Chemical etching accommodates tight tolerances for intricate shapes at a low/reasonable fabrication cost. However, other fabrication techniques for the electrical contacts 140 may be used, such as stamping, fine-blanking, progressive die cutting, and the like. The various electrical contacts 140 may undergo any appropriate processing prior to being incorporated into the electrical connector 130 (e.g., the above-noted plating).

It should be noted that the various electrical contacts 140 present a mating connector interface surface 148 that is sufficiently large to accommodate a least a certain degree of misalignment between the electrical connector 130 and a mating connector (e.g., the electrical connector 104). The mating connector interface surface 148 of each electrical contact 140 again is that which interfaces with the electrical contact of a mating electrical connector (e.g., tab 114 from a corresponding electrical contact 112 of the electrical connector 104, and that will be discussed in more detail below in relation to FIGS. 4A-B). Having the mating connector interface surfaces 148 in the form of an enhanced length accommodates a degree of misalignment between the electrical connector 130 and a mating electrical connector (e.g., electrical connector 104), while still allowing for a suitable electrical connection. Moreover, a misalignment between the electrical connector 130 and a mating electrical connector (e.g., electrical connector 104) should not adversely affect the structural integrity of the various electrical contacts 140 based upon their ability to flex or deflect to a least a certain degree (again, preferably by an elastic or near-elastic deformation).

Each electrical contact 140 is also able to flex or deflect to at least a certain degree. More specifically and in the illustrated embodiment, the first section 146 of each electrical contact 140 in effect is in the form of a simply supported beam which is able to flex or deflect. Flexing or deflection of the first section 146 of each electrical contact 140 is desirable when establishing contact with the electrical contact of a mating connector (e.g., electrical contact 112 of electrical connector 104). During this flexing or deflection, the first section 146 tends to slide on the interfacing surface of the mating connector. This rubbing or scraping action of the first section 146 of each electrical contact 140 may remove surface oxides or the like on the interfacing surface of the mating connector, but in any case is believed to enhance the electrical interconnection.

At least one insulator 150 is disposed between each adjacent pair of electrical contacts 140 as noted above. Each insulator 150 used by the electrical connector 130 may be formed from any appropriate material or combination of materials that provides a desired degree of electrical insulation between adjacent electrical contacts 140. The various insulators 150 are of a common size, shape, and configuration, although such may not be required in all instances. In the illustrated embodiment, the various insulators 150 and the various electrical contacts 140 are of a common configuration, although the insulators 150 are illustrated as having a reduced width (e.g., the dimension corresponding with the length dimension of the shaft 134) than the electrical contacts 140. Other configurations of the electrical connector 130 may have the insulators 150 with the same width as the electrical contacts 140, while yet other configurations of the electrical connector 130 may have the insulators 150 with a larger width than the electrical contacts 140.

Each insulator 150 includes a first section 156, a second section 154, and a third section 152. The shaft 134 extends through an aperture on the third section 152 of each insulator 150 in the illustrated embodiment. The second section 154 disposes its corresponding first section 156 in spaced relation to its corresponding third section 152. The first section 156 of each insulator 150 includes a surface 158 that is flat, although other surface profiles may be appropriate. The surfaces 158 associated with insulators 150 within a common stack 133 are co-planar. In the illustrated embodiment: 1) the surfaces 158 of the insulators 150 in a common stack 133 are coplanar with the surfaces 158 of the insulators 150 within the other stack 133, although such may not be required in all instances; and 2) the mating connector interface surfaces 148 of the electrical contacts 140 within each stack 133 are also coplanar with the surfaces 158 of the insulators 150 within the same stack 133, although such may not be required in all instances.

The various insulators 150 may be fabricated in any appropriate manner, such as by a die cutting process. Moreover, the various insulators 150 may undergo any appropriate processing prior to being incorporated into the electrical connector 130.

Figure 2:
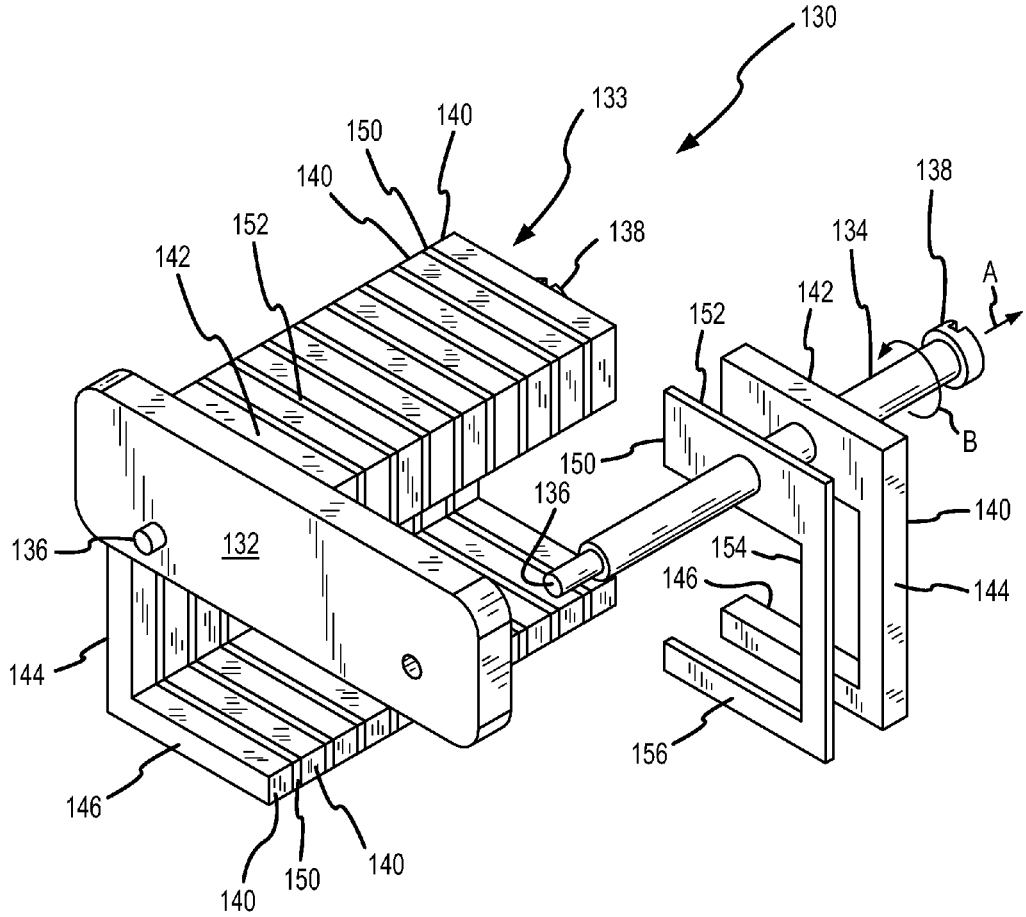
FIG. 2 is a partial exploded, perspective view of the electrical connector with stacked electrical contacts used by the electrical apparatus of FIG. 1A.
Figure 3A:
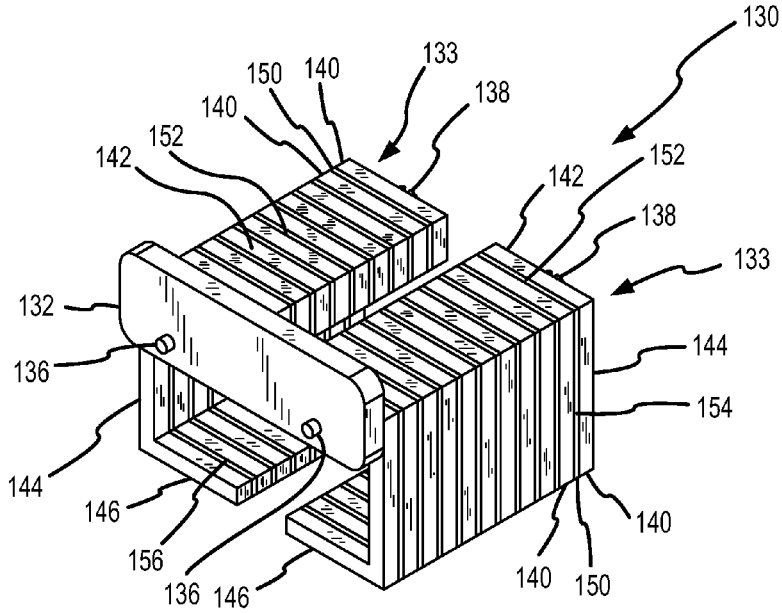
FIG. 3A is one perspective end view of the electrical connector with stacked electrical contacts used by the electrical apparatus of FIG. 1A.
Figure 3B:
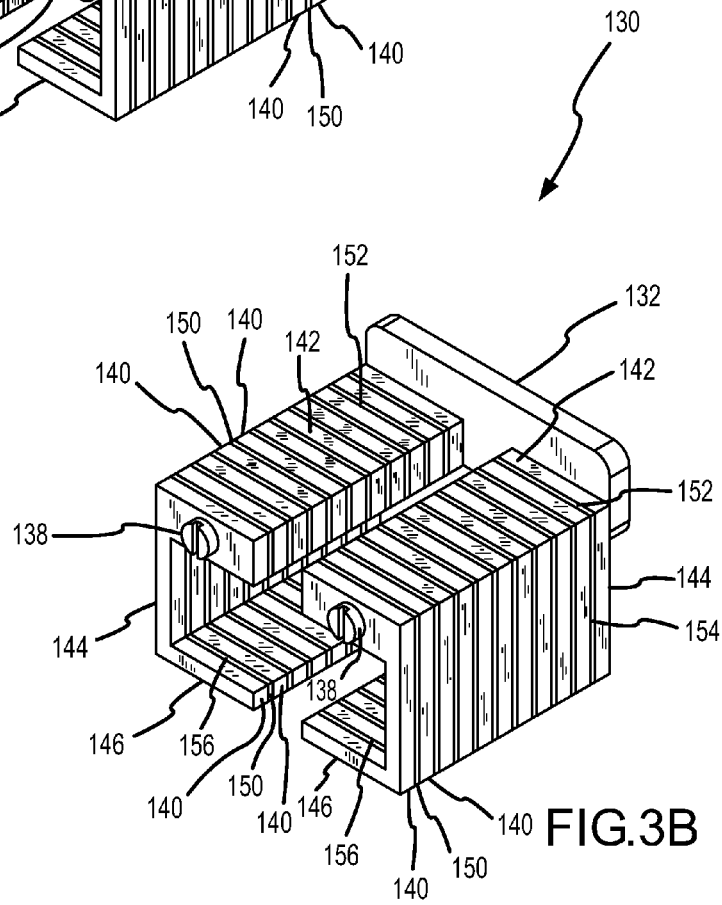
FIG. 3B is another perspective end view of the electrical connector with stacked electrical contacts used by the electrical apparatus of FIG. 1A.
Figure 3C:
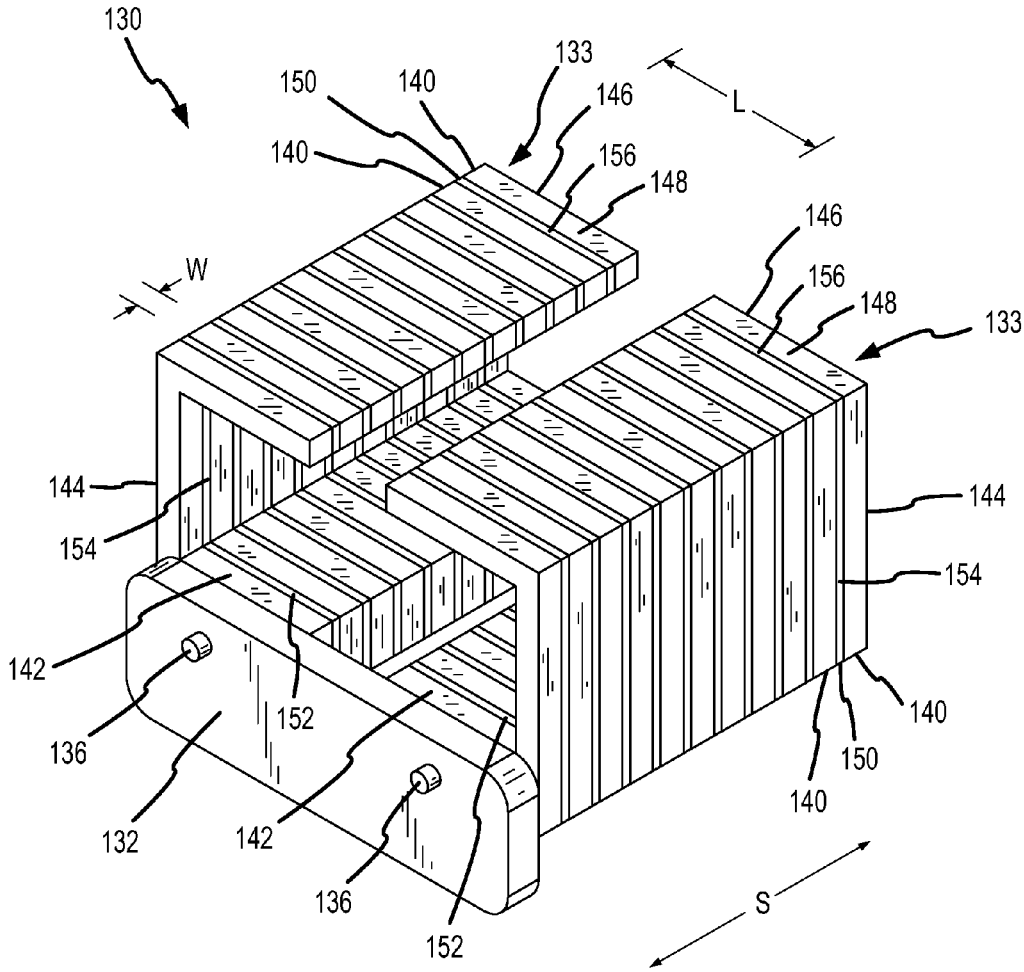
FIG. 3C is an enlarged perspective view of the electrical connector with stacked electrical contacts used by the electrical apparatus of FIG. 1A, and that illustrates the flat mating connector interface surfaces of the various electrical contacts.

FIG. 2 illustrates the manner of assembling the electrical connector 130 in the case of the illustrated embodiment that uses a shaft 134 to define a stack 133. An end plate (not shown) may be slid onto an end 136 of the shaft 134, and thereafter slid along the shaft 134 in the direction of the arrow A until encountering a head 138 of the shaft 134. Alternatively and in accordance with the illustrated embodiment, the head 138 of the shaft 134 may provide one of the abutments for assembling the electrical connector 130. In any case, electrical contacts 140 and insulators 150 are slid onto the shaft 134 via its end 136 and in alternating relation, and then are slid along the shaft 134 in the direction of the head 138 or in the direction of the arrow A. Again, at least one insulator 150 is disposed between each adjacent pair of electrical contacts 140 within each stack 133. Once the desired/required number of electrical contacts 140 and insulators 150 have been positioned on the shaft 134, the end 136 of the shaft 134 may be threaded to an end plate 132 (e.g., by rotating the shaft in the direction of the arrow B). The end plate 132 may be of any appropriate size, shape, and/or configuration, and further may be formed from any appropriate material or combination of materials. The various electrical contacts 140 and insulators 150 may be compressed between the end plate 132 and the head 138 of the corresponding shaft 134 (or another end plate that is disposed between the head 138 of the shaft 134 and the adjacentmost electrical contact 140 or insulator 150 as noted) to maintain the third sections 142 of the electrical contacts 140 and the third sections 152 of the insulators 150 in a fixed position relative to each other. In the illustrated embodiment, both shafts 134 interface with a common end plate 132, although such may not be required in all instances.

Figure 4A:
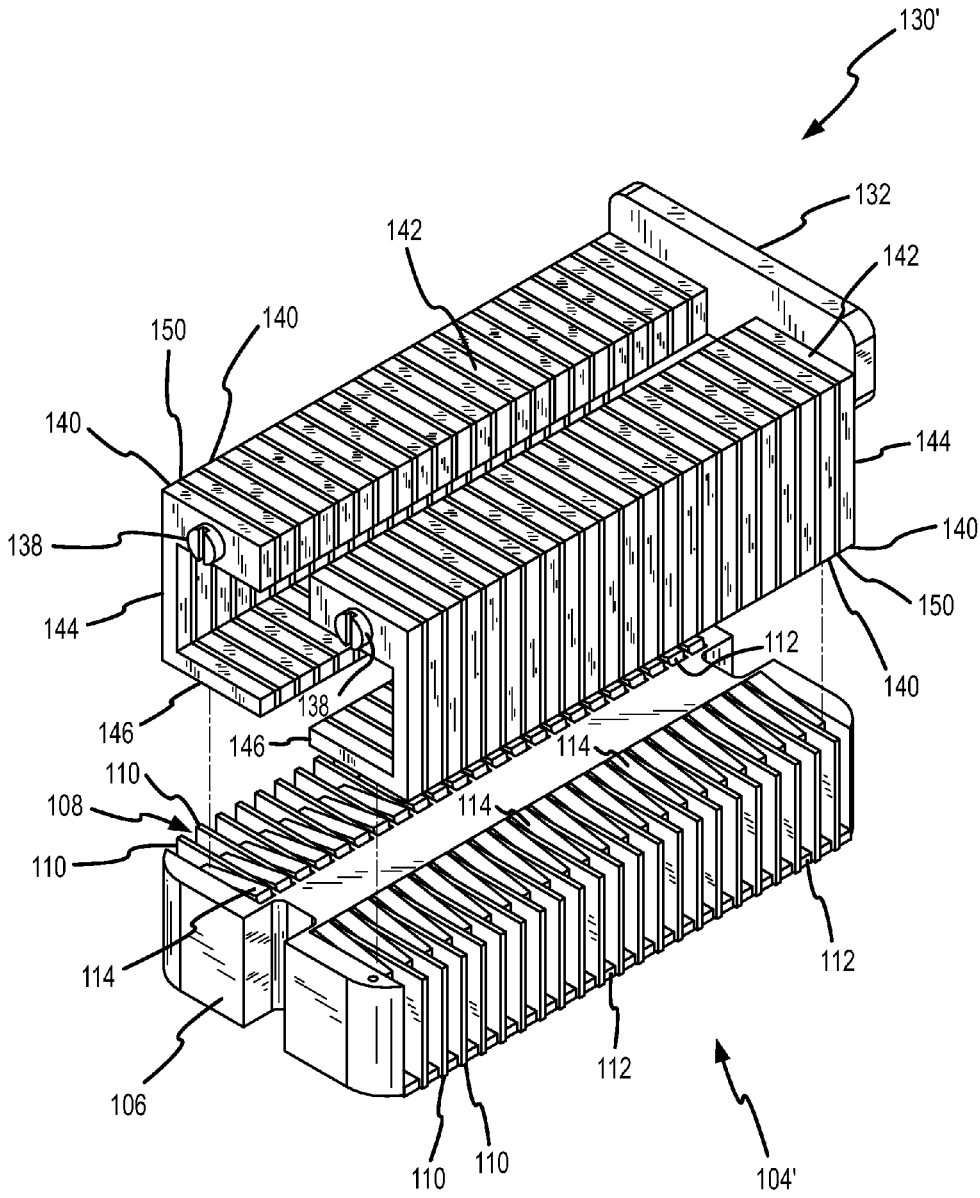
FIG. 4A is a perspective view of a variation of the electrical connector with stacked electrical contacts illustrated in FIG. 1A, in alignment with but disengaged from a variation of the electrical connector used by the device under test of FIG. 1B.

FIG. 4A is an example of an alternate embodiment for the electrical connector 104 of the device 100, and which is electrically connectable with the above-described electrical connector 130 of the ETE 120. Since the electrical connectors illustrated in FIG. 4A each uses a different number of electrical contacts from that illustrated in FIGS. 1A and 1B, respectively, the electrical connector 104' and 130' each include the noted "single prime" designation. Stacking of electrical contacts 140 and insulators 150 in alternating relation to define an electrical connector 130/130' provides flexibility to readily adapt the electrical connector 130/130' for various sizes/configurations of mating connectors as previously noted.

The electrical connector 104' of FIG. 4A generally includes an integral body 106 having a plurality of slots 108 along two opposing sides thereof. Each adjacent pair of slots 108 is separated by a rib 110 (i.e., the ribs 110 are part of the one-piece body 106), and an electrical contact 112 is disposed within each of the slots 108. One end or end portion of each electrical contact 112 could be mounted to a printed circuit board or the like. The opposite end of each electrical contact 112 is in the form of a deflectable tab 114 that protrudes beyond the upper surface of the connector 104' in the illustrated embodiment.

Figure 4B:
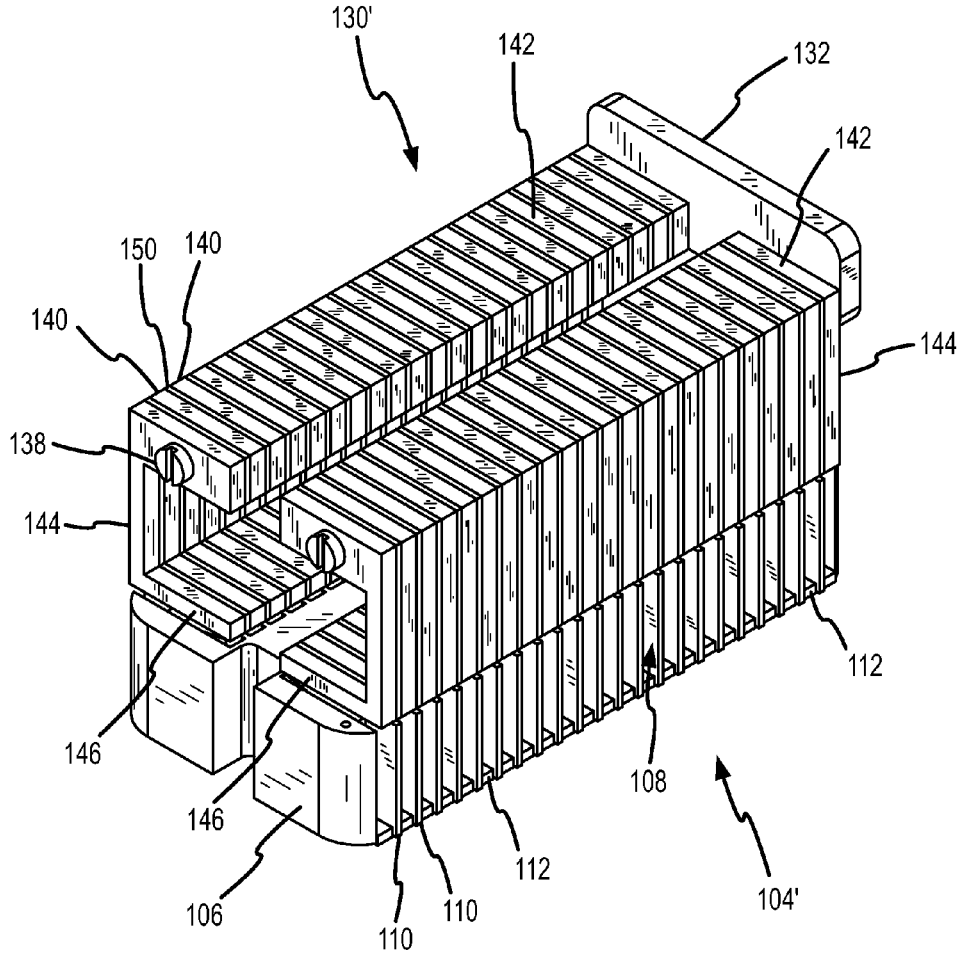
FIG. 4B is a perspective view of an engaged position for the electrical connectors of FIG. 4A.

FIGS. 4A and 4B illustrate the manner in which the electrical connector 130 of the ETE 120 and the electrical connector 104 of the device 100 are electrically interconnected, but again in the context of the electrical connector 130' and electrical connector 104' in accordance with the foregoing. The mating connector interface surfaces 148 of the electrical contacts 140 from the electrical connector 130' are aligned with the tabs 114 of the electrical contacts 112 from the electrical connector 104', and with the connectors 130', 104' being disposed in spaced relation. That is, the mating connector interface surface 148 of the first sections 146 of each electrical contact 140 of the electrical connector 130' is properly aligned with a corresponding one of the tabs 114 of the electrical contacts 112 for the electrical connector 104'. Thereafter, the electrical connector 104' may be axially advanced relative to the electrical connector 130' (i.e., relative motion is all that is required, and which may be provided in any appropriate manner) to dispose the mating connector interface surface 148 of each electrical contact 140 from the electrical connector 130' into engagement with its corresponding tab 114 of the electrical contact 112 from the electrical connector 104'. The engagement of the mating connector interface surfaces 148 of the electrical connector 130' may cause the corresponding tab of the electrical contact 112 to deflect to a certain degree, may cause the first section 146 of each electrical contact 140 to deflect or flex to a degree, or both, although such may not be required in all instances. A "sliding" of each first section 146 along its corresponding tab 114 again is desired for purposes of the electrical connection between the connectors 104', 130'. Moreover, the engagement of the electrical connector 130' with the electrical connector 104 may result in the surface 158 of the first section 156 of each insulator 150 from the electrical connector 130' being disposed on an end of a corresponding rib 110 of the electrical connector 104', although such may not be required in all instances.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An electrical connector pair, comprising:

an electrical connector; and a mating connector, wherein the electrical connector includes a plurality of first electrical contacts, wherein the plurality of first electrical contacts provide mating connector interface surfaces configured to mate with a plurality of electrical contact tabs included in the mating connector, wherein each of the mating connector interface surfaces are larger than the corresponding electrical contact tabs included in the mating connector to provide a relaxed alignment tolerance for engaging and establishing electrical communication between the electrical connector and the mating connector; and a separate first insulator disposed between each adjacent pair of said first electrical contacts, wherein said plurality of first electrical contacts and each said first insulator are stacked in a first dimension.

2. The electrical connector pair of claim 1, wherein each said mating connector interface surface is flat, and wherein said mating connector interface surfaces of said plurality of first electrical contacts are at least substantially coplanar.

3. The electrical connector pair of claim 1, wherein each said mating connector interface surfaces comprises a metal plating.

4. The electrical connector pair of claim 1, wherein each said mating connector interface surface is oriented at least substantially orthogonally to a direction of a relative movement required for said electrical connector to electrically engage the electrical contact tabs of the mating electrical connector.

5. The electrical connector pair of claim 1, wherein said plurality of first electrical contacts share a common shape with each said first insulators.

6. The electrical connector pair of claim 1, wherein each of said plurality of first electrical contacts and each said first insulator are separate, discrete structures so as to be stackable.

7. The electrical connector pair of claim 1, wherein each said first insulator is disposed in interfacing relation with each said first electrical contact of its corresponding said adjacent pair of said first electrical contacts.

8. The electrical connector pair of claim 1, further comprising a first shaft, wherein each of said plurality of first electrical contacts and each said first insulator is mounted on said first shaft.

9. An electrical assembly comprising the electrical connector pair of claim 1 and a printed circuit board, wherein the electrical connector of claim 1 is mounted on said printed circuit board.

10. The electrical connector pair of claim 1, wherein a width dimension associated with each said mating connector interface surface coincides with said first dimension in which said plurality of first electrical contacts and each said first insulator are stacked, wherein a length dimension associated with each said mating connector interface surface is orthogonal to said width dimension, and wherein a length is greater than a width in the case of each said mating connector interface surface.

11. The electrical connector pair of claim 10, wherein the relaxed alignment tolerance for engaging and establishing electrical communication between the electrical connector and the mating connector occurs in the length dimension.

12. The electrical connector pair of claim 1, wherein each said first electrical contact comprises a deflectable cantilever that in turn comprises its corresponding said mating connector interface surface.

13. The electrical connector pair of claim 12, wherein each said first electrical contact is an integral structure.

14. The electrical connector pair of claim 12, where said deflectable cantilever for each of said plurality of first electrical contacts are disposed in at least substantially parallel relation.

15. The electrical connector pair of claim 1, wherein each said first electrical contact comprises a deflectable section and a stationary section, and wherein said deflectable section of each said first electrical contact is engageable with an electrical contact of the mating connector.

16. The electrical connector pair of claim 15, wherein each said first electrical contact is an integral structure.

17. The electrical connector pair of claim 15, wherein said deflectable section for each of said plurality of first electrical contacts is in the form of a cantilever.

18. The electrical connector pair of claim 17, wherein a length of each said cantilever extends in a dimension that is orthogonal to said first dimension in which said plurality of first electrical contacts and each said first insulator are stacked.

19. The electrical connector pair of claim 17, where said deflectable cantilevers of said plurality of first electrical contacts are disposed in at least substantially parallel relation.

20. A disk drive station comprising:

an electrical apparatus that in turn comprises an electrical connector, wherein the electrical connector comprises:

a plurality of first electrical contacts, wherein the plurality of first electrical contacts provide mating connector interface surfaces configured to mate with a plurality of electrical contact tabs included in a mating connector, wherein each of the mating connector interface surfaces are larger than the corresponding electrical contact tabs included in the mating connector to provide a relaxed alignment tolerance for engaging and establishing electrical communication between the electrical connector and the mating connector, and a separate first insulator disposed between each adjacent pair of said first electrical contacts, wherein said plurality of first electrical contacts and each said first insulator are stacked in a first dimension; and a disk drive that is detachably engaged with the electrical connector, wherein the disk drive includes the mating connector.

* * * * *